United States Patent [19]

Gooch et al.

[11] Patent Number: 4,971,569

[45] Date of Patent: Nov. 20, 1990

[54] SELF-TERMINATING COAXIAL TAP CONNECTOR

[75] Inventors: Sherwin J. Gooch, Cupertino; Ted G. Kummert; James I. Moulton, both of Sunnyvale, all of Calif.; Mark D. Rustad, Richfield, Minn.

[73] Assignee: Apple Computer, Inc., Cupertino, Calif.

[21] Appl. No.: 369,382

[22] Filed: Jun. 21, 1989

[51] Int. Cl.[5] ..... H01R 17/04; H01R 33/96

[52] U.S. Cl. ..... 439/188; 200/51.1; 333/22 R; 439/581

[58] Field of Search ..... 439/63, 188, 578–585, 439/507, 515; 200/51.09, 51.1, 51 R; 33/22 R, 260

[56] References Cited

U.S. PATENT DOCUMENTS

| | | | |
|---|---|---|---|
| 3,873,785 | 3/1975 | Lieberman | 200/51.1 |
| 4,099,825 | 7/1978 | Jackson | 439/188 |
| 4,575,694 | 3/1986 | Lapke et al. | 200/51.1 |
| 4,588,249 | 5/1986 | Blichasz et al. | 439/583 |
| 4,666,231 | 5/1987 | Sheesley et al. | 439/581 |
| 4,687,446 | 8/1987 | Birch et al. | 439/581 |
| 4,804,339 | 2/1989 | Cohen | 439/588 |
| 4,825,021 | 4/1989 | Pauza | 200/51.1 |

OTHER PUBLICATIONS

Data sheet on Amphenol automatic coaxial terminators, 362 series, Allied Amphenol Products, Mar. 1984, 2 pages.

Two pages entitled "AMP Incorporated Expetise in Self Terminating Connectors" listing items numbered 1–7, Jun. 23, 1989.

Network/ Premises Interconnection Products for voice, data, power, Catalog 86–780, Issued 9–86, 80 pages, AMP Products Corporation.

*Primary Examiner*—Neil Abrams

*Attorney, Agent, or Firm*—Mark Aaker

[57] ABSTRACT

A self-terminating network of stations connected by coaxial cable segments with each cable segment having ends with cable connectors for coupling to matching device connecters. Each connector has a switchable termination circuit de-activated by coupling to a matching connector. An uncoupled connector will serve as a terminator. The device connector can be a tap connector for mounting on a printed circuit board, for minimizing the length of the tap, and reducing the distrubance to an attached coaxial cable network.

4 Claims, 4 Drawing Sheets

SELF-TERMINATING COAXIAL TAP CONNECTOR

BACKGROUND

This invention relates to data communications networks using coaxial cable and connectors, in particular to a network with self-terminating coaxial tap connectors.

FIG. 1 illustrates a known type of data communications network using coaxial cable and connectors. Coaxial cable segments 22 form a backbone which is tapped to connect to computers or peripheral stations 20. Connections are made by coupling cable connectors 26 to matching device connectors 29. Cable connectors 26 can be male BNC style plugs, while matching device connectors 29 can be female BNC style sockets. Each end of a cable segment 22 has a cable connector 26. FIG. 1A shows an exploded view of the connections to a T connector 28. A T connector 28 has two oppositely mounted device connectors 29 and an orthogonally mounted cable connector 26. The T connector's two device connectors 29 receive cable connectors 26 from two cable segments 22. The T connector's cable connector 26 connects to a device connector 29 on a transceiver 30. The transceiver 30 has a drop cable 32 connecting via a station connector 36 to a station 20. The specifications for a network of this type can be found in ANSI/IEEE Standard 802.3a, Medium Attachment Unit and Baseband Medium Specifications, Type 10BASE2 (Section 10), Institute of Electrical and Electronics Engineers, Inc., New York, 1987.

Other cable, tap, and connector configurations are possible. For example, the T connector 28 could be replaced with two device connectors 29 mounted on the case of transceiver 30. Then, two separate cable segments 22 with cable connectors 26 would each connect to a device connector 29 on transceiver 30. In this case, the tap or T connection would be formed internal within transceiver 30. Another alternative is to mount the electronics of transceiver 30 within the case of a station 20 and have two device connectors 29 mounted on the case of station 20. Again, the tap or T connection would be formed within station 20. Another alternative is to mount the electronics of transceiver 30 within the case of a station 20, but have a single device connector 29 mounted on the case of station 20, and use a T connector 28 to connect two cable segments 22 to the single device connector 29. In general, these coaxial networks will include cable connectors 26 coupling to device connectors 29 at numerous points in the network.

These cable configurations have a common problem. Connections to coaxial cable 22 must be carefully controlled to prevent disturbances in its characteristic impedance, which can cause signal loss and reflections which interrupt operation of the network. It is necessary to terminate any open connector such as an uncoupled cable connector 26, or an uncoupled device connector 29 on a T connector 28. This can be done with a terminator 34 which is matched to the characteristic impedance of coaxial cable 22. Should a cable end be uncoupled, dividing the network into two sections, neither section will function properly since each section has an open end which is not terminated. It is an object of this invention to form a network in which uncoupled connectors are automatically self-terminated, thereby allowing the separated network sections to remain operational.

It is also important when forming tap connections, such as by T connectors 28, or by wiring internal to a transceiver 30 or station 20, to minimize the length of the tap connection, that is the distance from the commonly connected coaxial cable connectors 26 to the termination of the tap at a transceiver 30. It is a further object of this invention to provide a tap connector which can be mounted on a printed circuit board, for minimizing the length of the tap, and reducing the disturbance to an attached coaxial cable network.

SUMMARY OF THE INVENTION

This invention provides a self-terminating network of stations connected by coaxial cable segments, with each cable connector coupling to a matching device connector. Device connectors can be on a T connector, transceiver, or station. Each cable connector or device connector has a switchable termination circuit de-activated by coupling to its matching connector. An uncoupled connector will serve as a terminator. In this way, at all times a connector is either coupled or terminated. This allows network sections to remain functional at all times. This invention also provides a self-terminating coaxial tap connector which can be mounted on a printed circuit board, for minimizing the length of the tap, and reducing the disturbance to an attached coaxial cable network.

DETAILED DESCRIPTION OF THE INVENTION

A self-terminating network of stations is formed by connecting stations by coaxial cable segments. Each end of a cable segment has a cable connector for coupling to a matching device connector. Each connector is self-terminating, with a switchable termination circuit so that the connector is either coupled or terminated. A terminated connector serves as a terminator to an attached transceiver, station, cable segment, or network. Therefore, sections of the network can remain operational despite the uncoupling of connectors that occurs in order to move cables or stations.

It is preferred that the switchable termination circuit be contained within a coaxial connector body of standard size and shape, and be mechanically switched by the coupling to a matching connector, conventional or self-terminating. It is preferred that all connectors used in this network be self-terminating, although conventional and self-terminating connectors can be mixed with a proportional reduction in the ability of the network sections to remain operational.

The connectors of this invention are useful in many forms of coaxial cable networks, but are especially useful to digital data communications networks. This invention is useful in coaxial or shielded connectors, especially the N and BNC styles of connectors. The invention is useful both in plug and socket, or male and female, configurations. In sockets, the center conductor is adapted to receive the matching center conductor of a plug, but the common terminology "center conductor" will be used for both plugs and sockets. In sockets, the shield is adapted to receive a matching surrounding shield sleeve of a matching plug, but the common terminology "shield" will be used for both plugs and sockets. T connectors or tap connectors will have two connector ports or sockets, preferably incorporating self-termination, with a third connector or tap, usually mounted orthogonal to the two connector ports or sockets.

The device connector is preferably a tap connector which can be mounted on a printed circuit board, for minimizing the length of the tap, and reducing the disturbance to an attached coaxial cable network. In a preferred form, the printed circuit board mountable tap connector would have two BNC sockets, a center tap for connection to a printed circuit board, and mounting tabs for mechanical mounting and connection to the shield. Tap connectors of other size and mounting configuration can be used.

Figure 1A:
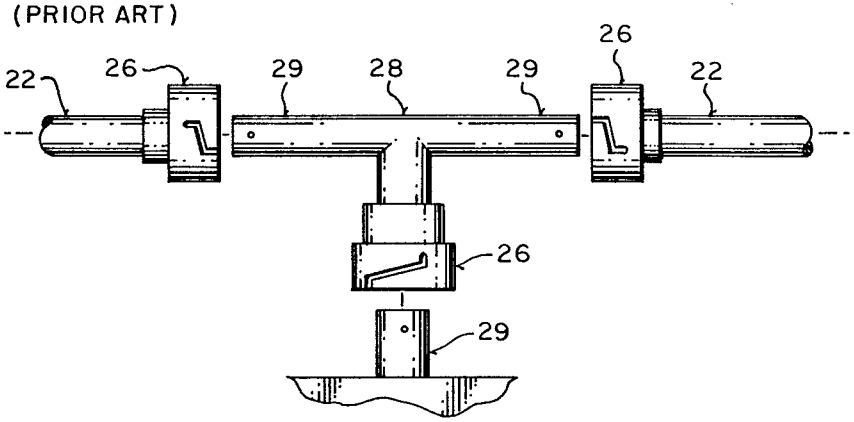
FIG. 1A (PRIOR ART)
FIG. 1A shows an exploded view of the connections to a T connector 28.
Figure 1:
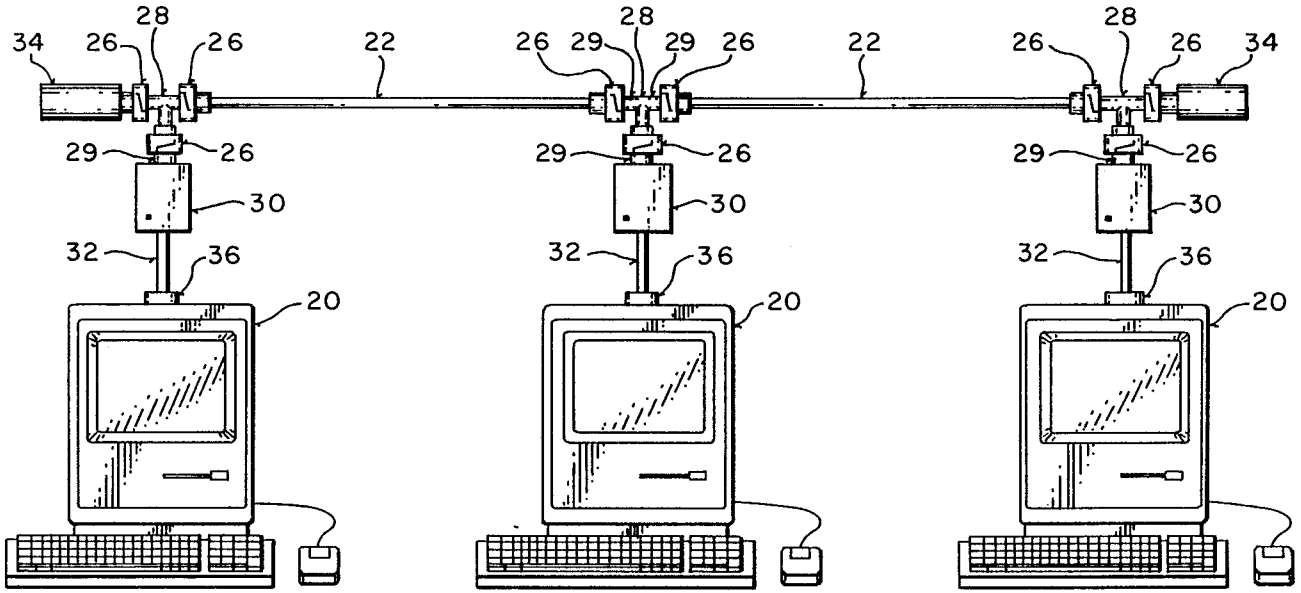
FIG. 1 (PRIOR ART)
FIG. 1 illustrates a known type of data communcations network using coaxial cable and connectors.
Figure 2:
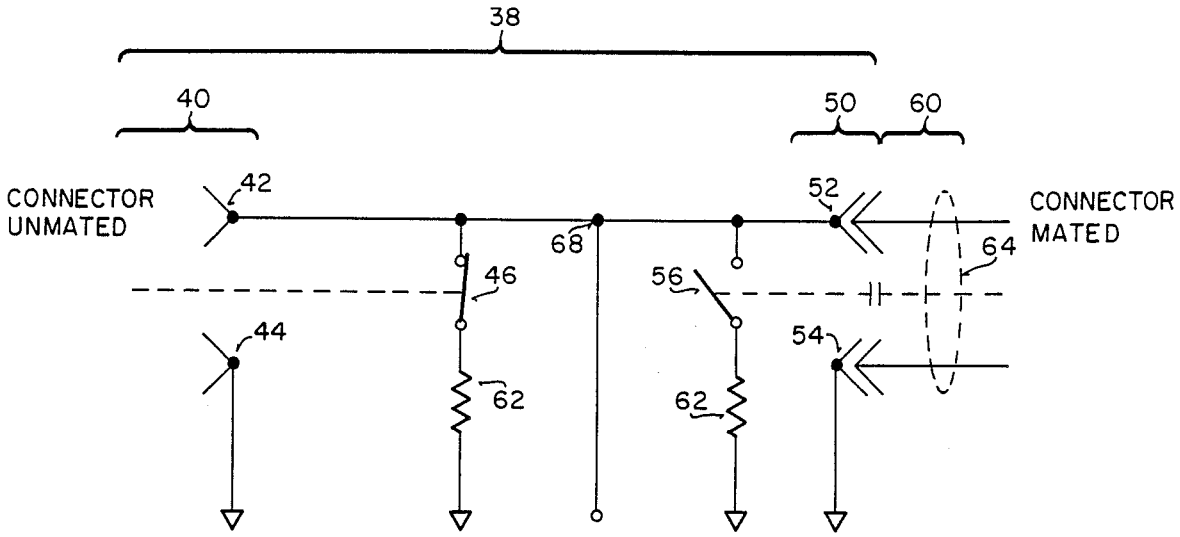
FIG. 2 shows an electrical schematic for a self-terminating tap connector with independent termination circuit elements in accordance with this invention.

FIG. 2 shows an electrical schematic for a self-terminating tap connector with independent termination circuit elements in accordance with this invention. The tap connector 38 has first and second coaxial sockets 40, 50. Socket 50 is shown coupled to a matching coaxial plug connector 60. Each coaxial socket 40, 50 has connected center conductors 42, 52 and connected shields 44, 54. The shields 44, 54 may be coupled by extending them to form a conducting case or shell for the tap connector 38.

Each socket 40, 50 has a switchable termination circuit such as a movable electrical contact 46, 56 connected to a termination circuit element 62. In an uncoupled connector, the switchable termination circuit is activated to serve as an electrical terminator. In a coupled connector, the switchable termination circuit is de-activated, so the connector is not terminated.

In uncoupled socket 40, electrical contact 46 is biased in contact with center conductor 42 completing a circuit from center conductor 42 through electrical contact 46 and termination circuit element 62 to shield 44. Termination circuit element 62 can be a resistor matching the characteristic impedance of the coaxial cable segments, for example 50 ohms.

In coupled socket 50, electrical contact 56 is detached from contact with center conductor 52, thereby deactivating the path through termination circuit element 62 to shield 54.

Tap connector 38 has a center tap 68 extending from the connected center conductors 42, 52 through the surrounding shields 44, 54 and ending in a tip for connection, for example, to a wiring trace on a printed circuit board.

Figure 3:
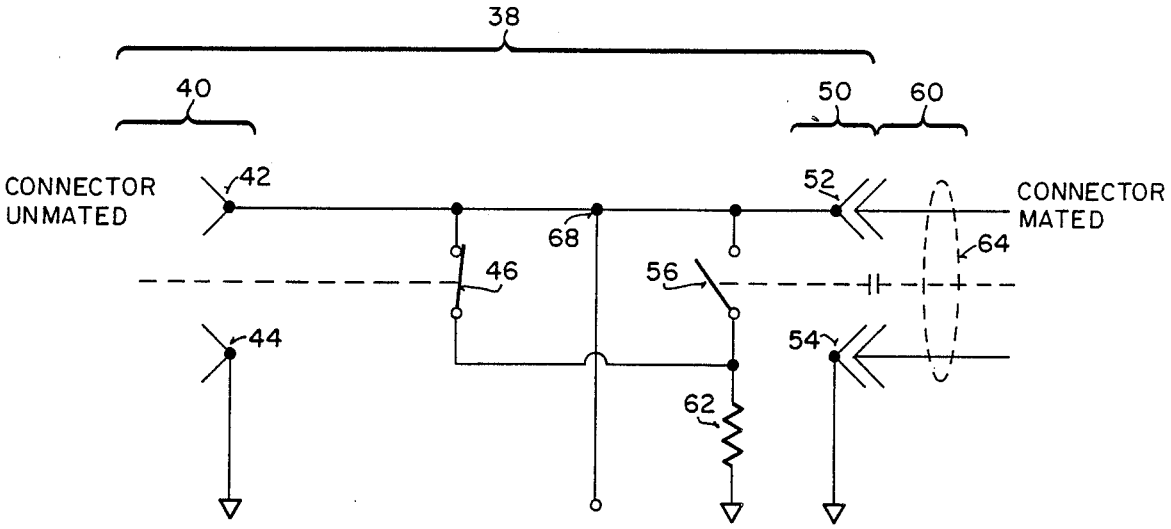
FIG. 3 shows an electrical schematic for a self-terminating tap connector with a single termination circuit element in accordance with this invention.

FIG. 3 shows an electrical schematic for a self-terminating tap connector with a single termination circuit element 62 in accordance with this invention. In this embodiment, the movable electrical contacts 46, 56 connect from their respective center conductors 42, 52, but are then joined and connected through a single termination circuit element 62 to connected shields 44, 54.

Figure 4:
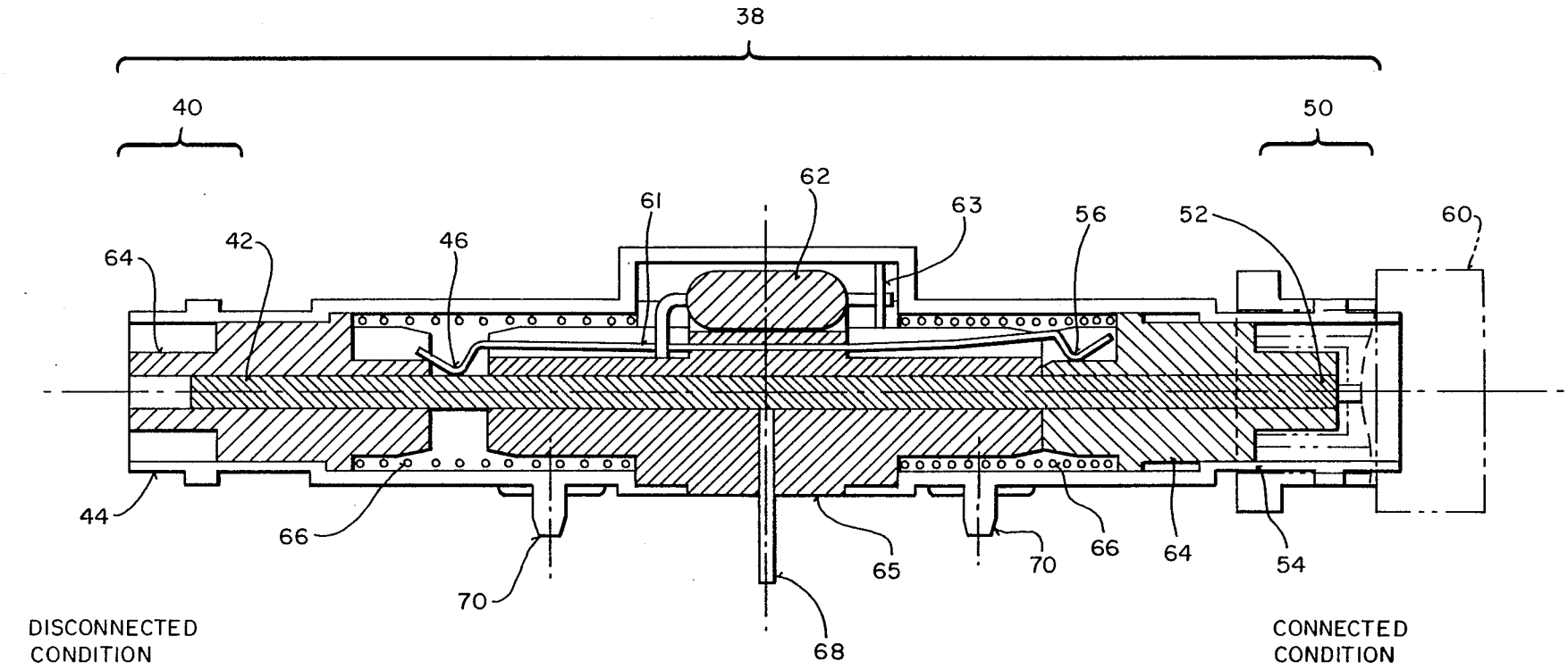
FIG. 4 shows a corresponding physical construction for a printed circuit board mountable, self-terminating tap connector in accordance with the schematic of FIG. 3.

FIG. 4 shows a corresponding physical construction for a printed circuit board mountable, self-terminating tap connector in accordance with the schematic of FIG. 3. The tap connector 38 has first and second coaxial sockets 40, 50. Socket 50 is shown coupled to a matching plug connector 60. Each socket 40, 50 has connected center conductors 42, 52 and connected shields 44, 54. The connected shields 44, 54 are extended to form a conducting case or shell for the tap connector 38. The connected center conductors 42, 52 can be supported within the connected shields 44, 54 by a dielectric support 65.

Each socket 40, 50 has a switchable termination circuit such as a movable electrical contact 46, 56 connected to a termination circuit element 62. In an uncoupled socket, the switchable termination circuit is activated to serve as an electrical terminator. In a coupled socket, the switchable termination circuit is deactivated, so the socket is not terminated.

In uncoupled socket 40, electrical contact 46 is biased in contact with center conductor 42 completing a circuit from center conductor 42 through electrical contact 46 and termination circuit element 62 connected to shields 44, 54. Termination circuit element 62 is a resistor matching the characteristic impedance of the coaxial cable, for example 50 ohms.

In coupled socket 50, electrical contact 56 is detached from contact with center conductor 52, thereby deactivating the path through termination circuit element 62 to shields 44, 54.

Electrical contacts 46, 56 can be made of spring metal to bias them against their respective center conductors 42, 52. Electrical contacts 46, 56 can be joined by a conducting strip 61 to connect to termination circuit element 62, which can be connected to shields 44, 54 by a ground clip 63.

Tap connector 38 has a center tap 68 extending from the connected center conductors 42, 52 through the surrounding dielectric 65 and connected shields 44, 54 and ending in a tip for connection, for example, to wiring trace on a printed circuit board.

Electrical contact 56 can be detached from center conductor 52 by various methods, but in a preferred embodiment, a sliding dielectric element 64 is moved within the connected shields 44, 54 by the insertion of the mating connector 60 to move the electrical contact 56 away from contact with the center conductor 52. The shape of the electrical contact 56 and the face of the sliding dielectric element 64 can be tailored to provide smooth sliding and switching. The sliding dielectric element 64 is normally biased away from electrical contact 56, for example by a spring 66.

Connector 38 can be made suitable for printed circuit board mounting by including mounting tabs 70 for mechanical mounting of connector 38, and for electrical connection to the connected shields 44, 54.

Figure 6:
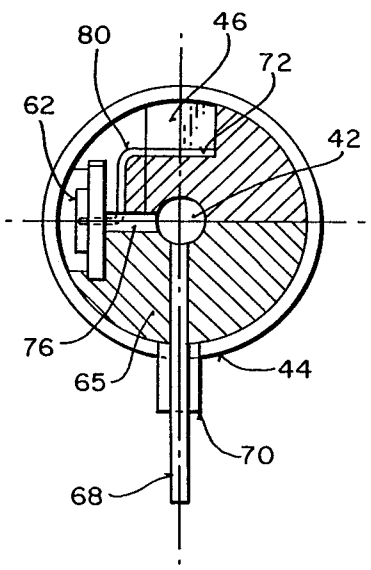
FIG. 6 shows an end view of the second physical embodiment of a self-terminating coaxial tap connector in accordance with this invention, illustrating the offset placement of the termination circuit element.
Figure 5:
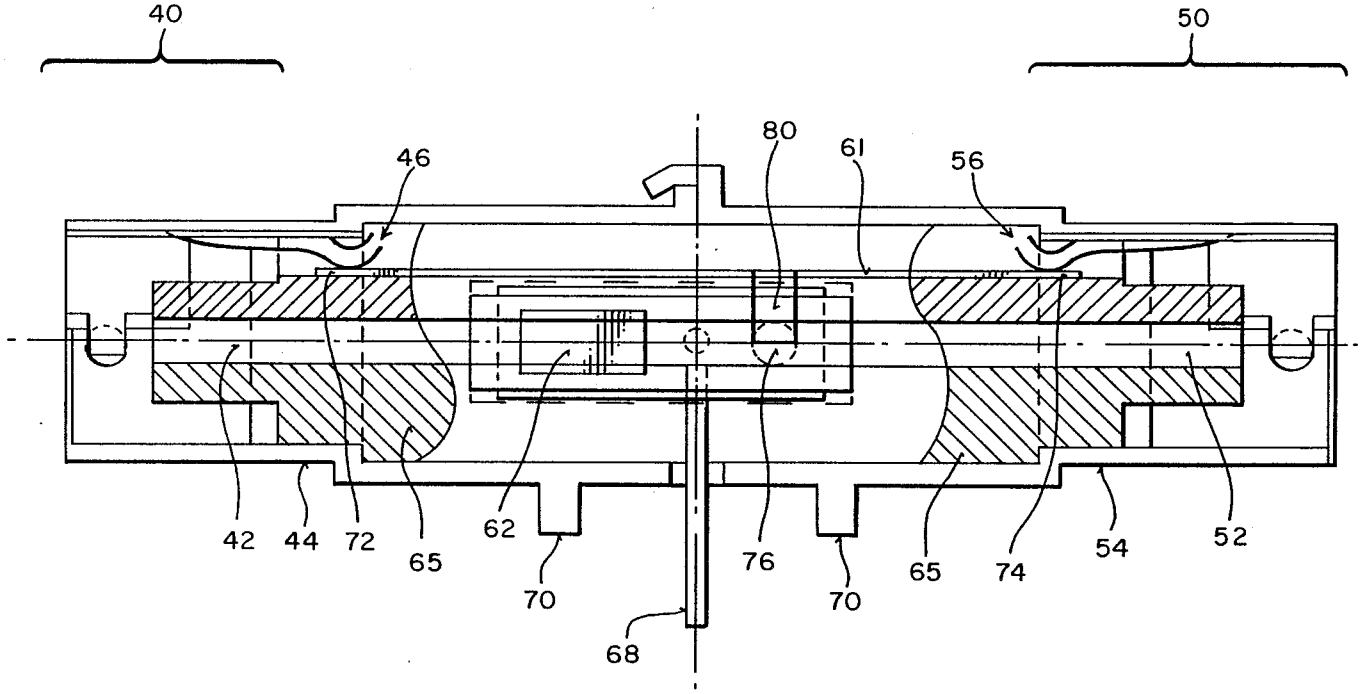
FIG. 5 shows a side view of a second physical embodiment of a self-terminating coaxial tap connector in accordance with this invention.

It should be apparent that the switchable termination circuit can be applied to other types of connectors and achieved in various ways, such as a second embodiment shown in FIGS. 5 and 6. FIG. 5 shows a side view of a second physical embodiment of a self-terminating coaxial tap connector in accordance with this invention. FIG. 6 shows an end view of the second physical embodiment of a self-terminating coaxial tap connector in accordance with this invention, illustrating the offset placement of the termination circuit element 62. The self-terminating coaxial tap connector of FIG. 5 has first and second coaxial sockets 40, 50. Each socket 40, 50 has connected center conductors 42, 52 and connected shields 44, 54.

A center tap 68 extends from the center of connected center conductors 42, 52 passing through connected shields 44, 54 and ending in a tip for connection, for example, to a wiring trace on a printed circuit board. Mounting of the connector to a printed circuit board can be done using mounting tabs 70 on the exterior of connected shields 44, 54.

Each socket 40, 50 has a switchable termination circuit. In this embodiment, the connected center conductors 42, 52 are connected via an orthogonal conductor 76 to a termination circuit element 62 which is mounted off to the side of connected center conductors 42, 52, but within the connected shields 44, 54. A second connection from termination circuit element 62 runs along a conducting strip 80 to a pair of contact lands 72, 74, one in each socket 40, 50, for receiving each of movable electrical contacts 46, 56 connecting to shields 44, 54. Movable electrical contacts 46, 56 can be made of spring metal to bias them in the position to reach contact lands 72, 74.

When uncoupled, electrical contacts 46, 56 are biased in contact with contact lands 72, 74 completing a circuit from center conductors 42, 52 through orthogonal conductor 76 to terminate circuit element 62; through termination circuit element 62 to conducting strip 80; through conducting strip 80 to contact lands 72, 74, electrical contacts 46, 56 and finally to shields 44, 54. Termination circuit element 62 is a resistor matching the characteristic impedance of the coaxial cable, for example 50 ohms.

When coupled, electrical contacts 46, 56 are moved by the insertion of the mating connector to move the electrical contacts 46, 56 away from contact with the contact lands 72, 74, thereby de-activating the path through termination circuit element 62 to center conductors 42, 52.

It will be apparent to one skilled in the art to apply the teachings of these embodiments to other forms of connectors and networks, and such adaptation can be done without departing from the true scope and spirit of the invention as defined by the following claims.

What is claimed is:

1. A self-terminating tap connector adapted for mounting on a printed circuit board, comprising:

first and second coaxial connector ports with connected center conductors and connected shields;

a center tap connected to said connected center conductors and extending through and ending external of said connected shields;

mounting tabs on said connected shields for attaching said tap connector to a printed circuit board;

first and second movable electrical contacts within said first and second coaxial connector ports, for contacting to each of said center conductors;

a sliding dielectric element within each of first and second coaxial connector ports, said sliding dielectric element moved by an inserted mating connector for disconnecting a corresponding said movable electrical contact from contacting a respective said center conductor; and termination circuit element electrically connected to said movable electrical contacts for switchable termination of said center conductors through said termination circuit element to said connected shields, whereby coupling of an inserted mating connector moves said sliding dielectric to disconnect said movable electrical contact from contacting a respective said center conductor, disconnecting said termination circuit element from said center conductor.

2. A self-terminating tap connector as in claim 1 wherein said connector is of a BNC style.

3. A self-terminating tap connector adapted for mounting on a printed circuit board, comprising:

first and second coaxial connector ports with connected center conductors and connected shields;

a center tap connected to said connected center conductors and extending through and ending external of said connected shields;

mounting tabs on said connected shields for attaching said tap connector to a printed circuit board;

first and second commonly connected contact lands within said connected shields;

first and second movable electrical contacts within said first and second coaxial connector ports, for contacting from said shields to said first and second commonly connected contact lands; and a termination circuit element electrically connected from said first and second commonly connected contact lands to said connected center conductors;

whereby coupling of an inserted mating connector moves a said movable electrical contact to disconnect said movable electrical contact from contacting said shield to said contact land, thereby disconnecting said termination circuit element from said shield.

4. A self-terminating tap connector as in claim 3 wherein said connector is of a BNC style.

* * * * *